US007369786B2

(12) United States Patent
Nagasu et al.

(10) Patent No.: US 7,369,786 B2
(45) Date of Patent: May 6, 2008

(54) SHEET TRANSPORTING APPARATUS AND PRINTING APPARATUS

(75) Inventors: Tsuyoshi Nagasu, Ibaraki (JP); Sadanori Kobashi, Ibaraki (JP); Shinji Nagayama, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 100 days.

(21) Appl. No.: 11/482,853

(22) Filed: Jul. 10, 2006

(65) Prior Publication Data

US 2007/0014585 A1 Jan. 18, 2007

(30) Foreign Application Priority Data

Jul. 15, 2005 (JP) ..... P2005-206933

(51) Int. Cl.
*G03G 15/20* (2006.01)
*G03G 15/00* (2006.01)

(52) U.S. Cl. ..... 399/68; 399/18; 399/322

(58) Field of Classification Search ..... 399/16, 399/18, 67, 68, 322, 395, 400
See application file for complete search history.

(56) References Cited

U.S. PATENT DOCUMENTS 4,419,003 A * 12/1983 Fujie et al. ..... 399/322
4,890,140 A * 12/1989 Negoro et al. ..... 399/322
RE34,685 E * 8/1994 Negishi et al. ..... 399/322

FOREIGN PATENT DOCUMENTS

JP 2003-160262 6/2003

* cited by examiner

*Primary Examiner*—Sandra L. Brase
(74) *Attorney, Agent, or Firm*—McGinn IP Law Group, PLLC

(57) ABSTRACT

A sheet transporting apparatus includes: a heating roller and a pressure roller that heats and presses a toner image to fix the toner image onto the sheet; a pressure roller detection unit that detects a contact posture of the rollers; a sheet meander correction mechanism that corrects a meander of the sheet by varying a difference in pressures between the rollers at both ends of the rollers; and a microprocessor that computes and stores the amount of the meander and the amount of correction, wherein the toner is fixed on the sheet when the contact posture is within a fixable range, and wherein when the pressure roller detection unit detects that the contact posture is out of the fixable range during transport of the sheet, the contact posture is controlled to return to a predetermined fixable posture, and the microprocessor corrects an error in the amount of correction.

3 Claims, 3 Drawing Sheets

SHEET TRANSPORTING APPARATUS AND PRINTING APPARATUS

BACKGROUND OF THE INVENTION

1. Field of the Invention

The present invention relates to an electrophotographic printing apparatus such as a laser beam printer or a copier.

2. Description of the Related Art

JP-A-2003-160262 discloses a laser beam printer including a sheet transport mechanism that has a sheet meander correction mechanism that corrects a meander of a print sheet.

In a case where a backlash arises as a result of abrasion, or the like, of a drive section gear of the sheet meander correction mechanism, even when an amount of drive of a motor computed by a microprocessor is output to a motor drive circuit in order to correct the meander, a pressure roller sometimes fails to move correctly by an amount corresponding to the backlash of the gear. Because of this failure, positional data pertaining to the pressure roller managed by the microprocessor do not coincide with the real position of the pressure roller. When transport of the sheets is continued in this state, a single correction made on the meander corresponds to the amount of backlash of the drive section gear. Hence, no problems arise in corrections on the meander of a sheet or a transport of a sheet. However, when the corrections are performed repeatedly, an error between the positional data pertaining to the pressure roller managed by the microprocessor and the real position of the pressure roller by the backlash is accumulated. Eventually, the position of the pressure roller moves to a location where a fixing failure occurs, and there arises a case where the pressure roller detection unit detects an error. Even in the case of the motor of the drive section of the sheet meander correction mechanism temporarily looses synchronization, the positional data pertaining to the pressure roller managed by the microprocessor do not coincide with the actual position of the pressure roller, and there arises a case where an error is erroneously detected.

SUMMARY OF THE INVENTION

The present invention has been made in view of above circumstances, and provides a printing apparatus including a sheet meander correction mechanism. According to an embodiment of the invention, the sheet meander correction mechanism has high reliability even when a backlash arises for reasons of abrasion, or the like, of a gear in a drive section of the sheet meander correction mechanism.

According to an aspect of the invention, there is provided a sheet transporting apparatus including: a heating roller and a pressure roller that heats and presses a toner image transferred onto a sheet to fix the toner image onto the sheet, the pressure roller being disposed opposite with respect to the heating roller while contacting with each other, and sandwiching the sheet therebetween; a pressure roller detection unit that detects a contact posture of the heating roller and the pressure roller; a sheet meander correction mechanism that corrects a meander of the sheet by varying the contact posture of the heating roller and the pressure roller to vary a difference in pressures between the heating roller and the pressure roller at both ends in longitudinal direction of the pressure roller, based on an amount of correction to be made to the meander of the sheet; sheet position detection unit that detects an amount of the meander of the sheet; and a meander computation and storage unit that computes and stores the amount of the meander and the amount of correction, based on the detected amount of the meander of the sheet, wherein the toner is fixed on the sheet when the contact posture is within a fixable range, and wherein when the pressure roller detection unit detects that the contact posture is out of the fixable range during transport of the sheet, the contact posture is controlled to return to a predetermined fixable posture, and the meander computation and storage unit corrects an error in the amount of correction.

A difference between the actual position of the pressure roller and the position of the pressure roller managed by a microprocessor is corrected.

When the contact posture fails to return to the predetermined fixable range during transport of the sheet, a printing operation may be aborted as an anomaly.

There can be provided a printing apparatus equipped with a sheet meander correction mechanism which is highly reliably even when a backlash arises in a gear for reasons of abrasion of the drive section of the sheet meander correction mechanism, or the like.

DETAILED DESCRIPTION OF THE INVENTION

Figure 2:
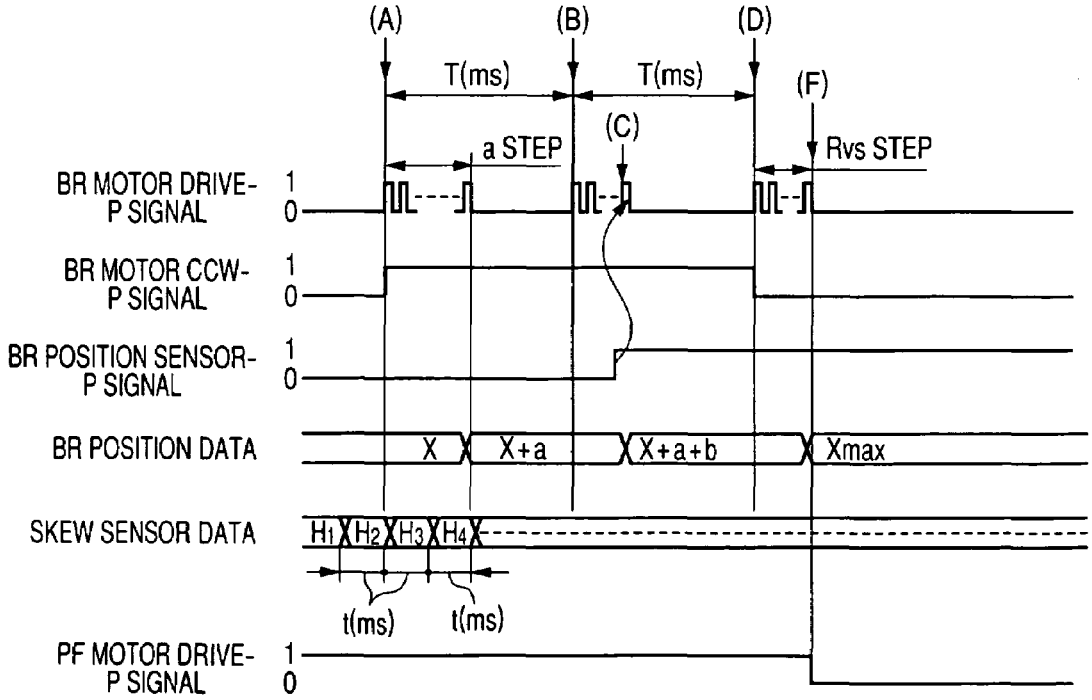
FIG. 2 is a timing chart showing an anomaly sequence employed when an anomaly arises during correction of an error in control for correcting a meander of a sheet according to the present invention.
Figure 3:
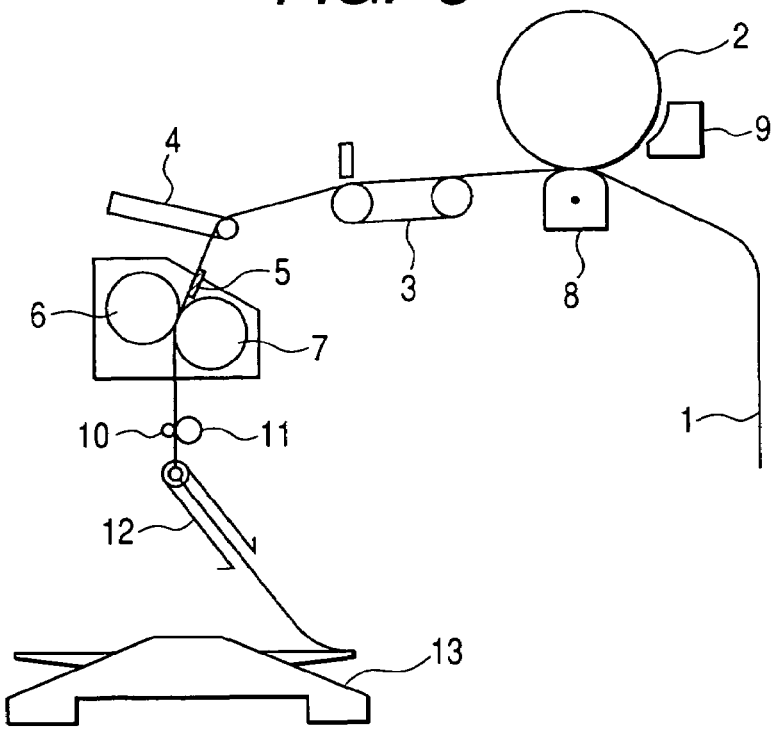
FIG. 3 is a schematic diagram of a sheet transport mechanism of a laser beam printer.

An embodiment of the present invention will be described with reference to FIGS. 1 to 5. FIG. 3 is a schematic diagram of a sheet transport mechanism of a laser beam printer.

A print sheet 1 is moved by a tractor 3 at the same speed as the cycle of a photosensitive drum 2. After a toner image developed by a developer 9 is transferred onto the print sheet 1 by means of a transfer device 8, the print sheet 1 passes through a buffer 4 that imparts given tensile force to the print sheet 1. After the print sheet 1 passes a sheet transport guide 5, the toner image is pressed and heated by a heating roller 6 and a pressure roller 7, to thus fuse the toner image on the print sheet 1. The print sheet 1 is pulled with given tensile force by means of a puller 11 and a puller roller 10. After the print sheet 1 is folded by a swing fin 12, the print sheet 1 is transported to a stacker 13 where the print sheet 1 is to be stacked. The sheet transport mechanism including a sheet meander correction mechanism that corrects meander of the print sheet 1.

This sheet meander correction mechanism varies the pressure at which the heating roller 6 and the pressure roller 7 contact each other on the both sides with respect to a sheet transport direction, to thus change sheet transport forces on the both sides of the heating roller 6 and the pressure roller 7, thereby correcting the meander of a sheet (see, e.g., JP-A-2003-160262).

Figure 4:
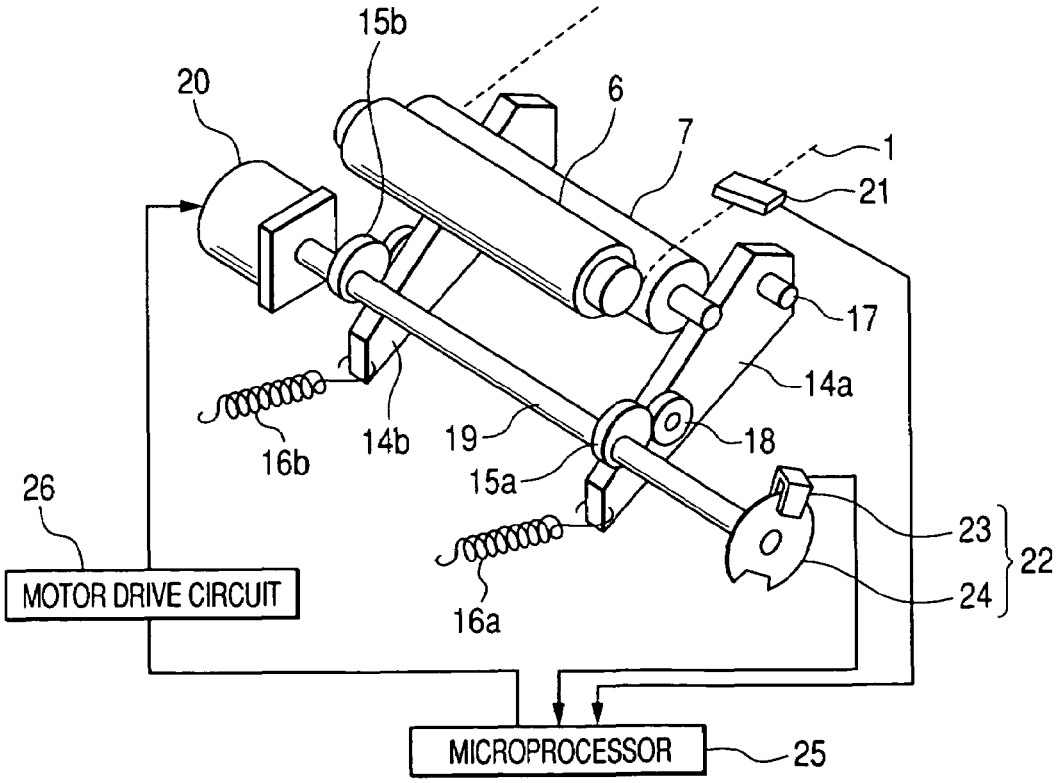
FIG. 4 is a diagrammatic view of a sheet meander correction mechanism.

FIG. 4 is a diagrammatic view of the sheet meander correction mechanism.

The pressure roller 7 is disposed opposite with respect to the heating roller 6 with the print sheet 1 sandwiched therebetween. A pressing unit that presses the pressure roller 7 against the heating roller 6 is constituted of an arm 14 (14*a*, 14*b*), a cam 15 (15*a*, 15*b*), and a spring 16 (16*a*, 16*b*). Two of the pressing units are provided on both sides of the pressure roller 7. The arm 14 has at one end thereof a bearing 17 and is rotatably supported by an unillustrated frame. The other end of the arm 14 is coupled to one end of the spring 16 and pulled toward the heating roller 6. The cam 15 is placed at a position where the cam contacts a cam follower 18 provided around the arm 14. The pair of cams 15*a* and 15*b* are coupled together by a cam shaft 19, and the cam shaft 19 is rotatably supported by the unillustrated frame and can be rotated by a motor 20. A rotatable shaft protrudes from both ends of the pressure roller 7, and the shaft keeps in contact with a portion of the arm 14 at all times.

Under nun-operating situation, the cam shaft 19 rotates such that the pressure roller 7 comes to a position apart from the heating roller 6, and stops.

During printing operation, the cam shaft 19 rotates, and the cams 15 are set apart from the cam followers 18. And the cam shaft 19 stops at a position where the pressure roller 7 is brought into full contact with the heating roller 6. At this time, the arms 14 press the pressure roller 7 by means of the springs 16, and the print sheet 1 is sandwiched between the pressure roller 7 and the heating roller 6. The pressure roller 7 is driven by rotation of the heating roller 6, and the print sheet 1 is transported while being subjected to fixing.

Sheet position during transportation of the print sheet 1 is detected by a skew sensor 21. The pair of cams 15 is fixed to the cam shaft 19 while phases of the cams 15 being different with each other. Provided that a counterclockwise direction when viewed from the left side of the cam shaft 19 is taken as positive, a cam 15*a* located on the left side with respect to the transport direction of the print sheet 1 is turned from a right cam 15*b* by +10°.

When the skew sensor 21 detects that the sheet position during transportation of the print sheet 1 is displaced leftward with respect to the transport direction thereof, the motor 20 rotates the cam shaft 19 counterclockwise when viewed from the left. By this movement, the left cam 15*a* comes into contact with the cam follower 18, to thereby bring the arm 14*a* slightly back down against the left spring force. Consequently, the left-side pressing force of the pressure roller 7 becomes smaller than the right-side pressing force, whereby the force for transporting the left side of a sheet becomes smaller than the force for transporting the right side of the sheet. Accordingly, the sheet position during transportation of the print sheet 1 moves rightward. Thus, the meander of the sheet can be corrected. When the sheet is displaced rightward, operation opposite to that mentioned above is performed.

Figure 5:
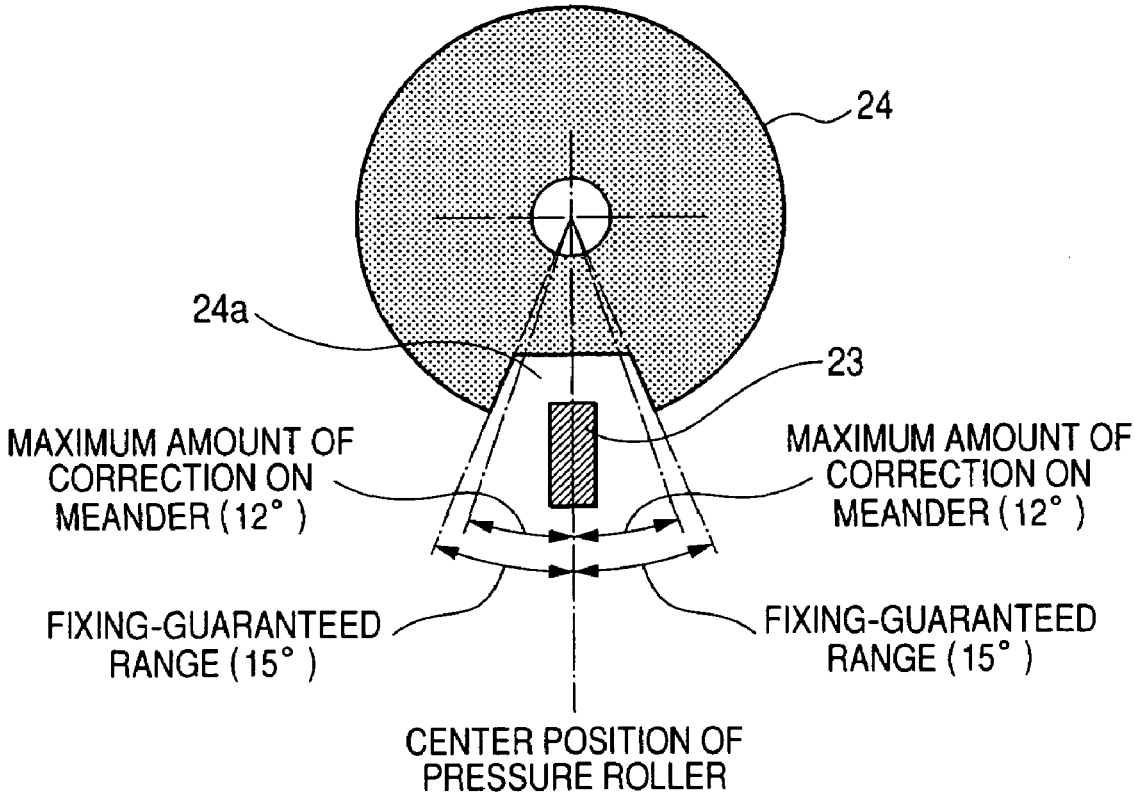
FIG. 5 is a schematic view of pressure roller detection unit of the sheet meander correction mechanism.

A pressure roller detection unit 22 is attached to the cam shaft 19, and includes a position sensor 23 and an encoder 24. As shown in FIG. 5, the encoder 24 is formed with a groove 24*a*, which extends by 15° in respective rightward and leftward directions with reference to the center position. During transport of the sheet, the position sensor 23 detects the groove 24*a*. In relation to the positional relationship between the encoder 24 and the position sensor 23, the encoder 24 and the position sensor 23 are fitted around the cam shaft 19 in such a way that the center of the groove 24*a* stops on the position sensor 23 when the cam shaft 19 rotates during printing operation and the pressure roller 7 come to the position where the pressure roller fully contacts the heating roller 6. During printing operation, the position of the cam shaft 19 rotates rightward and leftward as a result of correction of the meander of the sheet. The contact force existing between the heating roller 6 and the pressure roller 7 enables fixing of toner on the sheet even when the position of the camshaft 19 moves up to 15° rightward or leftward. Therefore, the groove 24*a* is formed so as to extend 15° in each of the right and left directions. When the position of the cam shaft 19 moves and exceeds 15° during printing operation, printing operation is stopped as an anomaly.

A microprocessor 25 acquires a signal from the skew sensor 21, which detects the sheet position during transportation of the sheet, at a given period; and computes the amount of corrections to be made on a meander from the amount of displacement from an ideal sheet position during transportation, the amount of change in the transport of the sheet, and the like. The thus-computed amount of correction to be made on the meander is output to a motor drive circuit 26, and the motor rotates by the amount corresponding to the amount of correction to be made on the meander, thereby correcting the meander of the sheet. A stepping motor is used for the motor 20, and the amount of correction to be made on the meander is computed by the number of steps taken by the motor. The microprocessor 25 adds the amount of correction to be made on the meander to the stored positional data pertaining to the pressure roller, thereby managing the position of the pressure roller 7. As shown in FIG. 4, a contact posture of the heating roller 6 and the pressure roller 7 can be moved so that the cam shaft 19 rotates through 12° in each of the right and left directions. In the case where the shaft 19 comes to a location which is beyond 12° in either the right or left directions when a correction is made to the meander of a sheet, the correction of the meander of the sheet is continued while the contact posture of the heating roller 6 and the pressure roller 7 is maintained at the posture where the cam shaft 19 has rotated by 12°.

An error in the control for correcting meander of a sheet and an error by the backlash of a gear are corrected with the current configuration by only a change in a program of the microprocessor, whereby a highly-reliable printing apparatus is realized.

Figure 1:
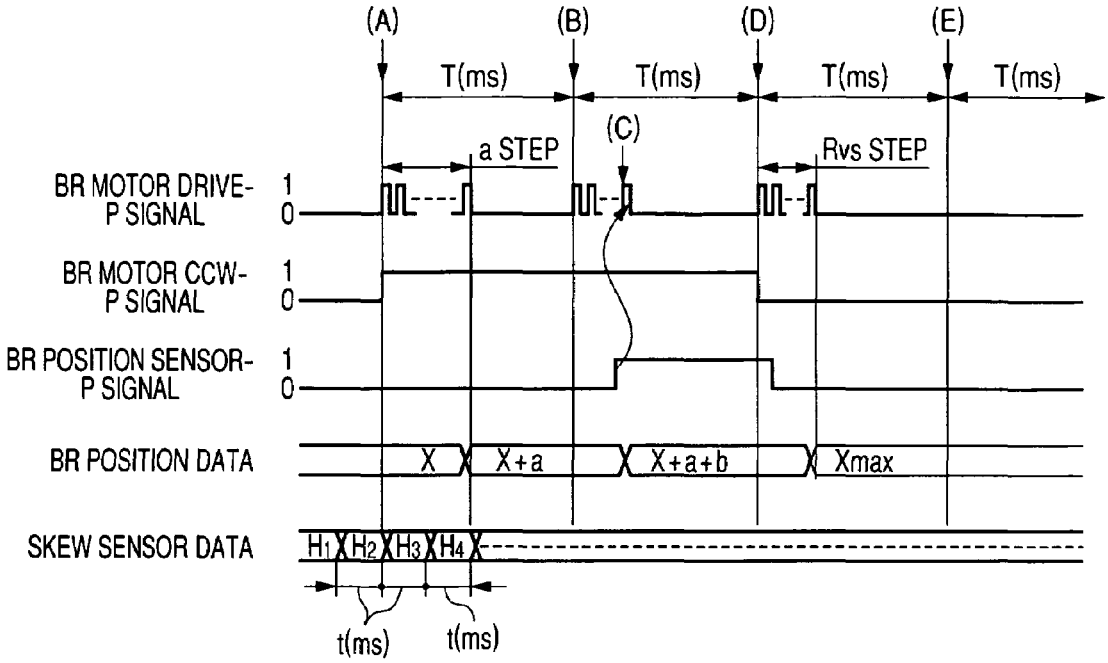
FIG. 1 is a timing chart showing a sequence employed when correction of an error in control for correcting meander of a sheet according to the present invention is performed.

FIG. 1 is a timing chart showing a sequence employed when correction of an error in control for correcting a meander of a sheet according to the present invention is performed. FIG. 2 is a timing chart showing an anomaly sequence employed when an anomaly arises during correction of an error in control for correcting a meander of a sheet. Skew Sensor Data are data pertaining to a mean value of sensor outputs read from a skew sensor 21 which detects a sheet position during transportation of a sheet. A BR Motor Drive-P signal is a pulse pertaining to the amount of driving of a motor 20. A BR Motor CCW-P signal is a signal showing a rotating direction of the motor 20. When the motor 20 is driven in order to correct the sheet meandering in the right direction with reference to the traveling direction of the sheet position during transportation of the sheet, the BR Motor CCW-P signal assuming a value of one is output. When the motor is driven in order to correct the sheet meandering in the left direction, the BR Motor CCW-P signal assuming a value of zero is output. The BR Position Data correspond to data pertaining to the position of a pressure roller 7 stored in a microprocessor 25. The BR Position Sensor-P signal is a sensor signal detected by pressure roller detection unit 22. When an edge of groove 24*a* is detected, the BR Position Sensor-P signal assumes a value of one.

A control performed when correction of an error in control for correcting meander of a sheet is performed will be described hereunder.

As shown in FIG. 1, during transport of a sheet, the microprocessor 25 reads an output from the skew sensor 21 at a given cycle, and computes a mean value of the outputs of n times. The thus-computed result is stored as Skew Sensor Data. As shown in FIG. 1, a mean value is computed at a cycle of t(ms). The computed mean values are taken as H1, H2, and H3, thereby updating a mean amount of meander of a sheet. The meander of the sheet is corrected at a given cycle T(ms). At the moment of correcting the meander of the sheet, the amount of driving of the motor 20 required to correct the meander of the sheet is computed based on the Skew Sensor Data. The amount of driving of the motor 20 is computed based on the amount of displacement from the ideal sheet position during transportation of the sheet, the amount of change between the current amount of meander and the previous amount of meander, and the amount of offset used for adding a given value on the basis of a determination as to whether or not the current position of the sheet is spaced from the ideal sheet position during transportation of the sheet. Computed results are output as the BR Motor Drive-P signal and the BR Motor CCW-P signal. At a moment (A) in FIG. 1, the amount of driving is computed as step "a" in the right direction, and hence the BR Motor CCW-P signal is caused to assume a value of one, and pulses corresponding to step "a" are output as the BR Motor Drive-P signal. After outputting the BR Motor Drive-P signal, the microprocessor 25 updates BR Position Data. Data, which are formed by adding the data, corresponding to step "a," to data "X" acquired before driving of the motor 20 in FIG. 1 are stored as the BR Position Data. When a moment (B) in FIG. 1 comes after lapse of T(ms), correction of a meander of a sheet is again performed. As in the case of the moment (A) shown in FIG. 1, in order to correct meander of a sheet, the amount of driving of the motor 20 is computed from the Skew Sensor Data. When the computed result exhibits step "b" in the right direction, pulses corresponding to step "b" is output.

As shown in FIG. 1, at a moment (C), the pressure roller 7 moves to a position out of the groove 24*a* in the cam shaft 19 during operation pertaining to step "b." When the position sensor 23 detects the BR Position Sensor-P signal, it is determined that fixing cannot be guaranteed, and transport of the sheet is stopped. According to the present invention, when the BR Position Sensor signal assumes a value of one during processing pertaining to step "b," the BR Motor Drive-P signal is caused to assume a value of 0 at that point in time, and driving of the motor 20 is stopped. When a moment (D) in FIG. 1 comes after lapse of T(ms), the BR Motor CCW-P signal is caused to assume a value of zero, and a pulse of Rvs step is output as the BR Motor Drive-P signal and the position of the pressure roller 7 is moved toward the center position by an amount corresponding to the Rvs step. Symbol "Rvs" represents the number of steps corresponding to a difference between the angle (15°) of the groove 24*a* and a maximum amount of correction on a meander (12°). When the motor 20 is driven by the Rvs step, the position of the pressure roller returns to the maximum meander correction position. Hence, the microprocessor 25 stores the number of steps "Xmax" corresponding to the maximum meander correction position as the BR Position Data. In a period subsequent to a moment (E) shown in FIG. 1 achieves after lapse of T(ms), the microprocessor 25 computes the amount of driving of the motor 20 from Skew Sensor Data, as in the case of the moment (A) in FIG. 1, to thus correct the meander of the sheet.

A difference between the actual position of the pressure roller 7 and the position of the pressure roller 7 managed by the microprocessor 25 is corrected as mentioned above.

There will now be described control operation performed in the event of an anomaly arises when an error in control for correcting a meander of a sheet is corrected.

As shown in FIG. 2, the moments (A) to (D) show moments when control analogous to that performed at the moments (A) to (D) in FIG. 1 is carried out. As indicated by (F) in FIG. 2, after a difference between the position of the pressure roller 7 and the position of the pressure roller 7 managed by the microprocessor 25 is corrected, the BR Position Sensor-P signal is considered to assume a value of one. However, the motor 20 cannot operate because of an anomaly in the motor 20 or a motor drive circuit 26. In this case, the position of the pressure roller 7 cannot return from a limit of a fixing-guaranteed range, which may cause a fixing failure. Therefore, control for correcting meander of a sheet cannot be continued. In this case, a PF Motor Drive-P signal used for driving a tractor 3 is caused to assume a value of zero and to stop transport of the sheet. An anomaly is reported to an unillustrated higher-level device.

The present invention may be applied to a sheet meander correction mechanism provided in a sheet transport mechanism of an electrophotographic printing apparatus, such as a laser beam printer or a copier.

The entire disclosure of Japanese Patent Application No. 2005-206933 filed on Jul. 15, 2005 including specification, claims, drawings and abstract is incorporated herein be reference in its entirety.

What is claimed is:

1. A sheet transporting apparatus comprising:

a heating roller and a pressure roller that heats and presses a toner image transferred onto a sheet to fix the toner image onto the sheet, the pressure roller being disposed opposite with respect to the heating roller while contacting with each other, and sandwiching the sheet therebetween;

a pressure roller detection unit that detects a contact posture of the heating roller and the pressure roller;

a sheet meander correction mechanism that corrects a meander of the sheet by varying the contact posture of the heating roller and the pressure roller to vary a difference in pressures between the heating roller and the pressure roller at both ends in longitudinal direction of the pressure roller, based on an amount of correction to be made to the meander of the sheet;

a sheet position detection unit that detects an amount of the meander of the sheet; and a meander computation and storage unit that computes and stores the amount of the meander and the amount of correction, based on the detected amount of the meander of the sheet, wherein the toner is fixed on the sheet when the contact posture is within a fixable range, and wherein when the pressure roller detection unit detects that the contact posture is out of the fixable range during transport of the sheet, the contact posture is controlled to return to a predetermined fixable posture, and the meander computation and storage unit corrects an error in the amount of correction.

2. The sheet transporting apparatus according to claim 1, wherein when the contact posture fails to return to the predetermined fixable range during transport of the sheet, a printing operation is aborted as an anomaly.

3. A printing apparatus comprising:

an image forming section that forms a toner image and transfers the toner image onto a sheet;

a heating roller and a pressure roller that heats and presses the toner image transferred onto the sheet to fix the toner image onto the sheet, the pressure roller being disposed opposite with respect to the heating roller while contacting with each other, and sandwiching the sheet therebetween;

a pressure roller detection unit that detects a contact posture of the heating roller and the pressure roller;

a sheet meander correction mechanism that corrects a meander of the sheet by varying the contact posture of the heating roller and the pressure roller to vary a difference in pressures between the heating roller and the pressure roller at both ends in longitudinal direction of the pressure roller, based on an amount of correction to be made to the meander of the sheet;

a sheet position detection unit that detects an amount of the meander of the sheet; and a meander computation and storage unit that computes and stores the amount of the meander and the amount of correction, based on the detected amount of the meander of the sheet, wherein the toner is fixed on the sheet when the contact posture is within a fixable range, and wherein when the pressure roller detection unit detects that the contact posture is out of the fixable range during transport of the sheet, the contact posture is controlled to return to a predetermined fixable posture, and the meander computation and storage unit corrects an error in the amount of correction.

* * * * *